US006409616B1

(12) United States Patent
Lin

(10) Patent No.: US 6,409,616 B1
(45) Date of Patent: Jun. 25, 2002

(54) CALORIE COUNTING RACKET

(75) Inventor: Wen-Sen Lin, Taichung (TW)

(73) Assignee: Topteam Technology Taiwan Co., Ltd., Taichung (TW)

( * ) Notice: Subject to any disclaimer, the term of this patent is extended or adjusted under 35 U.S.C. 154(b) by 0 days.

(21) Appl. No.: 09/855,495

(22) Filed: May 16, 2001

(51) Int. Cl.[7] ..... A63B 69/38
(52) U.S. Cl. ..... 473/553; 473/549; 473/463
(58) Field of Search ..... 473/553, 549, 473/461, 463, 524

(56) References Cited

U.S. PATENT DOCUMENTS 4,911,441 A * 3/1990 Brunner ..... 473/202
5,520,049 A * 5/1996 Butler, Jr. ..... 473/233
5,646,911 A * 7/1997 Davis ..... 368/10
6,134,965 A * 10/2000 Somville ..... 473/461
6,270,434 B1 * 8/2001 Shaw ..... 473/461

FOREIGN PATENT DOCUMENTS

DE 4007549 * 9/1991 ..... 473/FOR 183

* cited by examiner

*Primary Examiner*—Raleigh W. Chiu
(74) *Attorney, Agent, or Firm*—Rosenberg, Klein & Lee

(57) ABSTRACT

A calorie counting racket has a skeleton (10) with a hollow grip (11) and a counter unit (20) secured inside the grip (11) with multiple press buttons and a display (25) protruding from a side surface of the grip (11). The counter unit (20) has a microprocessor (21), a frequency counter (22) to record numbers of swings of the racket, a force estimating unit (23) to detect acceleration of the skeleton (10), a set of press button to control the microprocessor (21), and a display (25) to show calorie data. So that the calorie counting racket determine the burned calories immediately and precisely in accordance with different users.

10 Claims, 4 Drawing Sheets

CALORIE COUNTING RACKET

BACKGROUND OF THE INVENTION

1. Field of the Invention

The present invention relates to a racket, and more particularly a calorie counting racket, which calculates calories expended through exercise immediately and precisely while using this racket.

2. Description of Related Art

In order to ensure body health and keep in good shape, people at present take exercise. However, exercises vary greatly in the amount of energy spent, often to the surprise of the exercisers. That is, some sports may appear to be very active but in fact result in less energy spent than imagined. Therefore, correct calorie calculation is important because people can control their exercise and weight properly through effective exercise in a short time. Now, a lot of sports equipment, such as treadmills or exercise bikes, have calorie counters thereon to calculate the calories expended so people can know precisely how much energy they have spent, and the probable amount of weight lost. However, the calorie counter has not been seen in small sports devices like rackets, and furthermore, the calorie calculation of the sports equipment is only a rough estimation because the quantity of calories expended is different when people use different strengths.

Therefore, to overcome those shortcomings, the present invention tends to provide a calorie counting racket to calculate precisely calories expended when different forces are used to wield the racket.

SUMMARY OF THE INVENTION

The main objective of the invention is to provide a calorie counting racket to precisely calculate calories consumed when the racket is wielded with different strengths.

Advantages and novel features of the invention will become more apparent from the following detailed description when taken in conjunction with the accompanying drawings.

DETAILED DESCRIPTION OF PREFERRED EMBODIMENT

A calorie counting racket consists of a skeleton (10), and a counter unit (20).

Figure 1:
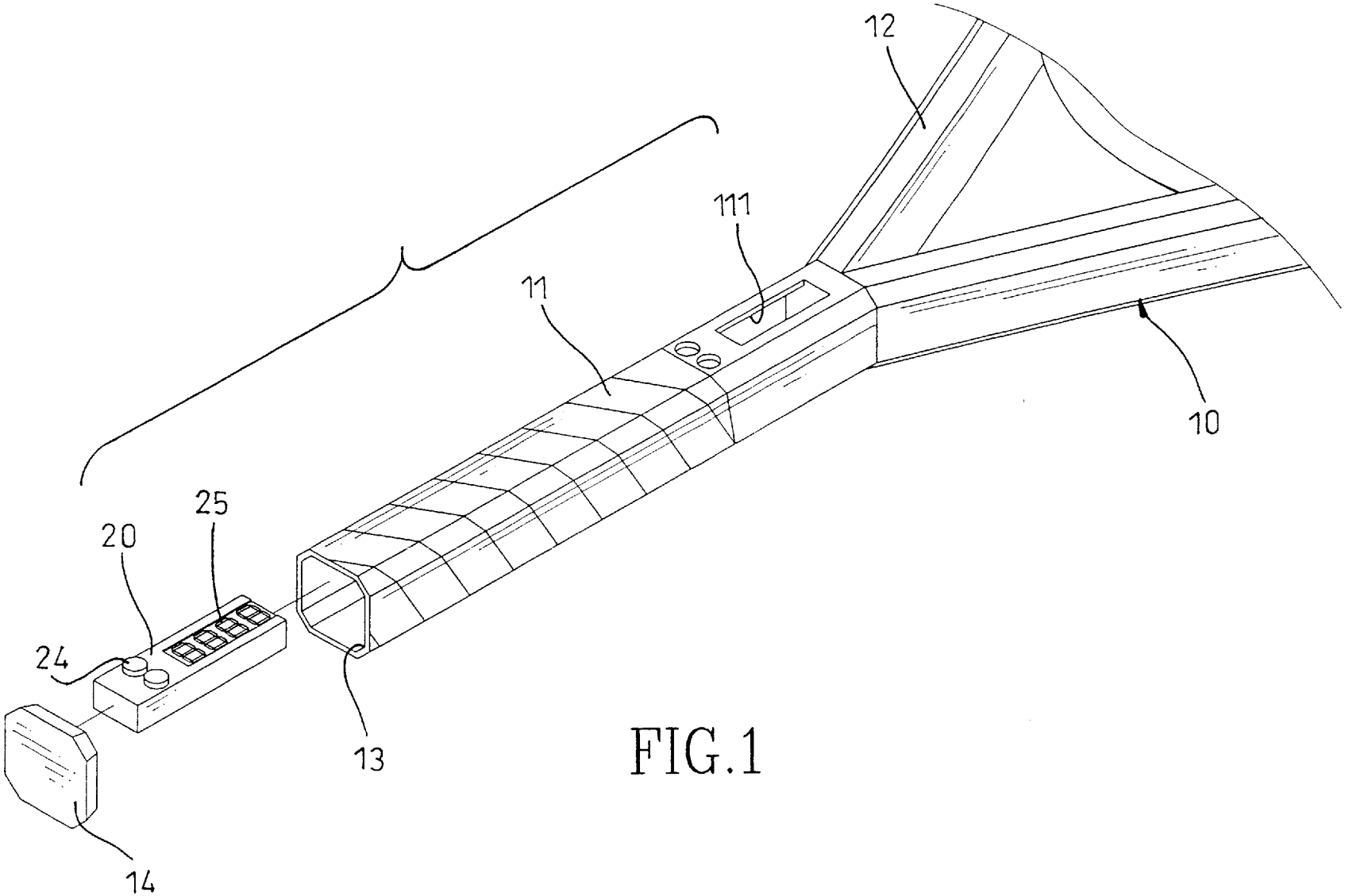
FIG. 1 is an exploded view of a calorie counting racket in accordance with the present invention.

With reference to FIG. 1, the skeleton (10) has a grip (11) and a frame (12) firmly secured with the grip (11). The grip (11) is hollow and has multiple cavities (111) defined in one side face of the grip (11), an aperture (13) defined in a distal end of the grip (11). A cap (14) is correspondingly mounted in the aperture (13).

Figure 2:
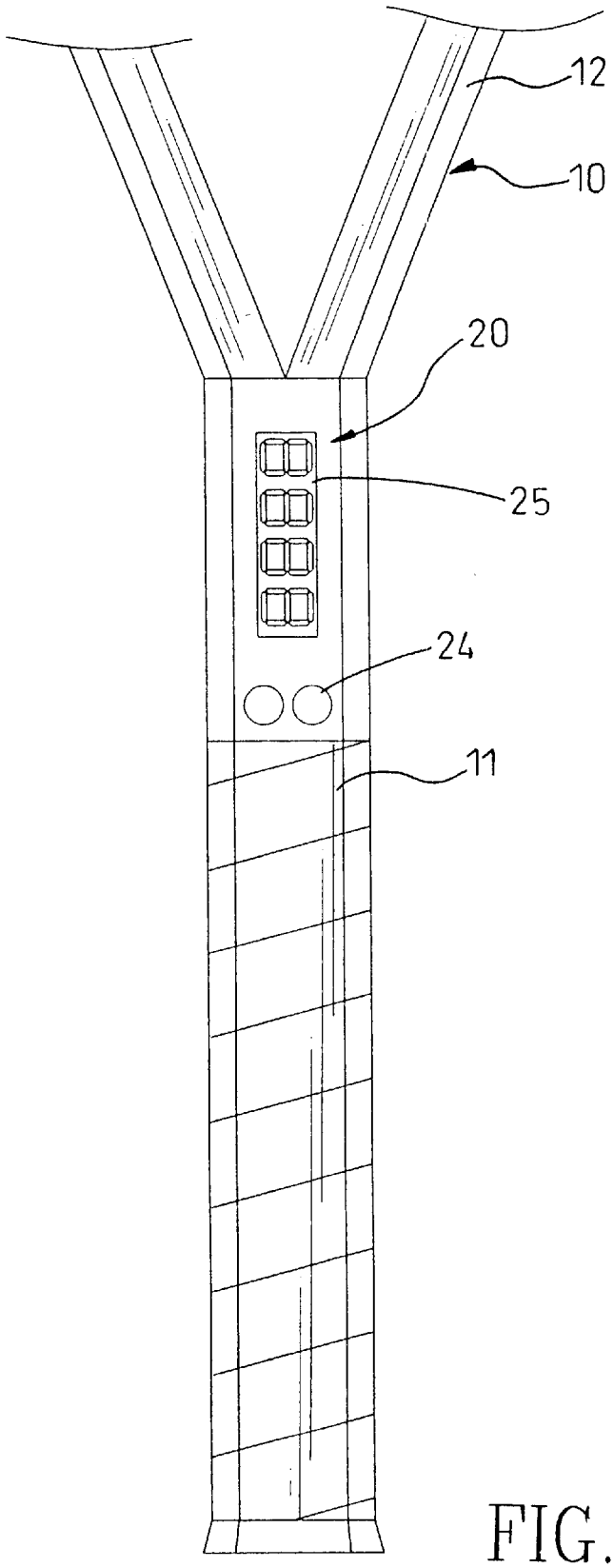
FIG. 2 is a side view of the calorie counting racket in accordance with FIG. 1.

The counter unit (20) is secured inside the grip (11) and has multiple press buttons (24) and a display (25) formed on the counter unit (20). Now with reference to FIG. 2, when assembling the calorie counting racket, the counter unit (20) is pushed inside the grip (11) whereafter the multiple press buttons (24) protrude from the grip (11) via the multiple cavities (111) to correctly position the counter unit (20). Then the cap (14) is mounted in the aperture (13) of the grip (11) to complete the assembly.

Figure 3:
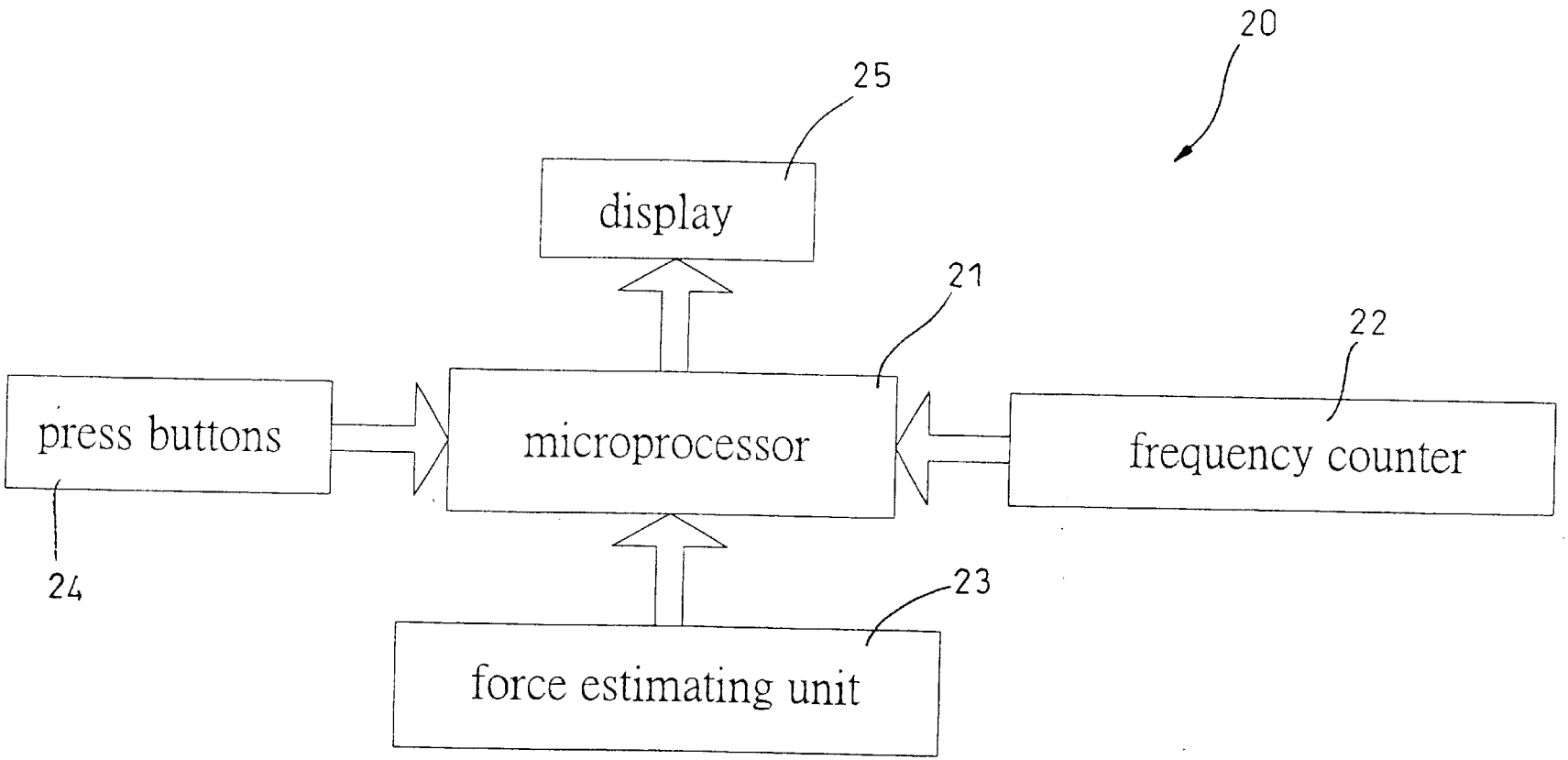
FIG. 3 is a block diagram of an electronic system of the calorie counting racket.

The counter unit (20) has multiple functional units as shown in FIG. 3 and the multiple functional units comprise a microprocessor (21), a frequency counter (22), a force estimating unit (23), the set of press buttons (24), and the display (25). The microprocessor (21) is the heart of this counter unit (20) and deals with all input from other functional units and then outputs to destined functional units. The set of press buttons (24) sends signals to the microprocessor (21) to activate some functions such as counting calories, and the microprocessor (21) sends a signal of results (a result of the counting) to show on the display (25). The frequency counter (22) and force estimating unit (23) record activity data, such as a number of swings and the strength of each swing, and transmits those data to the microprocessor (21). The microprocessor (21) summarizes those data to conclude a final result and sends them to the display (25). Additionally, the display (25) can be either a segment display or a liquid crystal display (LCD).

Figure 4:
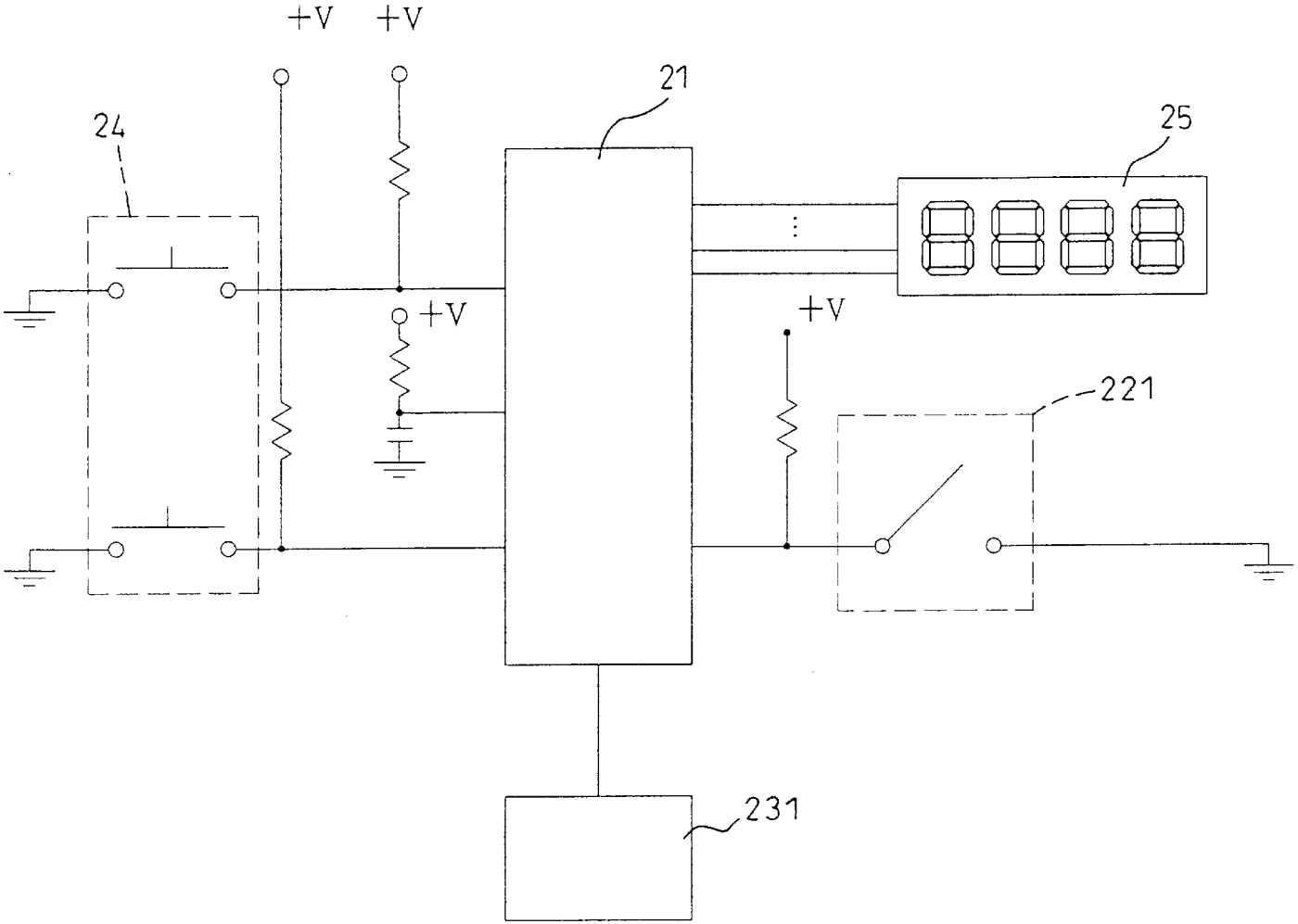
FIG. 4 is a circuit diagram of the calorie counting racket in accordance with FIG. 3.

A circuit diagram of the calorie counting racket is shown in FIG. 4, wherein the frequency counter (22) comprises a bounce switch (221) and the force estimating unit (23) comprises an acceleration sensor (231). The bounce switch (221) counts the number of swings, and at the same time, the acceleration sensor (231) detects positive acceleration of the racket and the negative acceleration of a ball when the ball impacts on the racket. Then the acceleration sensor (231) determines a total acceleration and sends the total acceleration to the microprocessor (20). The microprocessor (20) calculates a force value by the Newton force equation: $F=m\times a$ and finally sends the force value to show on the display (25).

In order to understand the usage of the calorie counting racket fully, please review FIG. 1 and 4 again in accompaniment with the following illustration.

When a user makes use of this invention, a start button of the set of press buttons is pressed first and the microprocessor (20) deletes previous data therein to restart a new counting process.

When the racket hits the ball, a shock against the ball occurs and the bounce switch (221) is activated by the shock so as that the frequency counter (22) records each shock by the bounce switch (221). At the same time, the force estimating unit (23) detects the de-acceleration of the impacted racket and sends the de-acceleration information to the microprocessor (20) to calculate the strength of each swing. The microprocessor also saves and accumulates the data of the number of impacts and the strength of each swing.

To know how many calories have been expended, a counting button is pressed to stimulate the microprocessor (20) to calculate total expended calories by appropriate equation programs. The data of expended calories is output to the display (25) and is shown thereon to enable the user to know of the expended calories or other data.

It is to be understood that the disclosure of the calorie counting racket is illustrative only, changes may be made in detail, especially the functional units in the counter unit (20) within the principles of the invention.

What is claimed is:

1. A calorie counting racket comprising:

a skeleton (10) having a grip (11) and a frame (12); and a counter unit (20) securable inside the grip (11) of the skeleton (10);

wherein the counter unit (20) comprising a microprocessor (21);

a frequency counter (22) electrically communicating with the microprocessor (21) and inputting quantities of swings of the racket to the microprocessor (21);

a force estimating unit (23) electrically communicating with the microprocessor (21) and inputting acceleration of the racket to the microprocessor (21);

press buttons (24) electrically communicating with the microprocessor (21) and to refresh data of the microprocessor (21); and a display (25) electrically communicating with the microprocessor (21) to display information from the microprocessor (21).

2. The calorie counting racket as claimed in claim 1, wherein the frequency counter is a bounce switch.

3. The calorie counting racket as claimed in claim 1, wherein the force estimating unit (23) is an acceleration sensor.

4. The calorie counting racket as claimed in claim 2, wherein the force estimating unit (23) is an acceleration sensor.

5. The calorie counting racket as claimed in claim 1, wherein the display (25) is a segment display.

6. The calorie counting racket as claimed in claim 2, wherein the display (25) is a segment display.

7. The calorie counting racket as claimed in claim 3, wherein the display (25) is a segment display.

8. The calorie counting racket as claimed in claim 1, wherein the display (25) is a liquid crystal display (LCD).

9. The calorie counting racket as claimed in claim 2, wherein the display (25) is a liquid crystal display (LCD).

10. The calorie counting racket as claimed in claim 3, wherein the display (25) is a liquid crystal display (LCD).

* * * * *